US005492170A

United States Patent [19]

Gil

[11] Patent Number: 5,492,170

[45] Date of Patent: Feb. 20, 1996

[54] DEVICE FOR RADIALLY SUPPORTING THE BUNDLE ENVELOPE AND SPACER PLATES OF A STEAM GENERATOR

[75] Inventor: Cornic Gil, Aubergenville, France

[73] Assignee: Framatome, Courbevoie, France

[21] Appl. No.: 269,609

[22] Filed: Jul. 5, 1994

[30] Foreign Application Priority Data

Jul. 5, 1993 [FR] France ..... 93 08188

[51] Int. Cl.[6] ..... F28F 9/00

[52] U.S. Cl. ..... 165/162; 122/510; 376/285

[58] Field of Search ..... 376/285, 402, 376/405; 165/81, 82, 160, 161, 162; 122/32, 34, 510, 512

[56] References Cited

U.S. PATENT DOCUMENTS

| | | | |
|---|---|---|---|
| 4,415,021 | 11/1983 | Bayless et al. | 165/162 |
| 4,503,903 | 3/1985 | Kramer | 165/162 |
| 4,655,281 | 4/1987 | Neybourger et al. | 165/162 |
| 4,690,206 | 9/1987 | Bein | 376/285 |
| 4,768,582 | 9/1988 | Wepfer | 376/285 |
| 5,583,584 | 4/1986 | Wepfer | 376/285 |

FOREIGN PATENT DOCUMENTS 2511491 2/1983 France .

2562996 10/1985 France .

*Primary Examiner*—Daniel D. Wasil

*Attorney, Agent, or Firm*—Pollock, Vande Sande & Priddy

[57] ABSTRACT

The invention relates to a device for the radial holding or supporting of the envelope of a bundle of tubes and spacer plates of a steam generator or boiler, constituted by stops or abutments traversing the wall of the bundle envelope and fixed to the wall level with the spacer plates. The abutments are distributed over the periphery of each spacer plate in order to radially separate the bundle envelope from the pressure envelope of the steam generator and to exert rigid supporting stresses between the spacer plates and the bundle envelope. The abutments are adapted for sliding on the inner face of the pressure envelope. Each abutment is constituted by a first part which comes into contact with the inner face of the pressure envelope, a second part and a third part coming into contact with the spacer plate. The second part serving as the intermediary between the first and third parts. The first part has a first thread permitting its fixing by screwing to the bundle envelope and a second thread. The second part has a first thread for screwing it to the second thread of the first part and a second thread having the opposite direction to the first thread. The third part has a thread permitting its screwing to the second thread of the second part and means for exerting rigid supporting stress on the spacer plate.

8 Claims, 2 Drawing Sheets

DEVICE FOR RADIALLY SUPPORTING THE BUNDLE ENVELOPE AND SPACER PLATES OF A STEAM GENERATOR

FILED OF THE INVENTION

The present invention relates to a device for the radial holding or supporting of the bundle envelope and the spacer plates of a steam generator boiler.

BACKGROUND OF THE INVENTION

Heat exchangers such as the steam generators of a pressurized water nuclear reactor have a tube bundle constituted by a very large number of small diameter tubes positioned vertically within a generally cylindrical bundle envelope located within the very thick, outer, rigid pressure envelope of the steam generator.

The pressurized water of the nuclear reactor circulates within the small diameter tubes and the water to be vaporized is introduced into the envelope of the bundle where it comes into contact with the outer surface of the tubes. The steam is recovered on the upper portion of the bundle envelope and is then generally dried in steam-water separators located in the outer envelope of the steam generator above the envelope of the tube bundle.

Steam generators constitute very high units, in which coaxial envelopes are arranged with a generally small, radial spacing.

It is known to use spacer plates into which pass the tubes of the bundle, distributed in accordance with the bundle height, in order to maintain the tubes in reciprocally fixed radial positions. These spacer plates are interconnected by vertical ties, the assembly being placed within the bundle envelope.

It is therefore important to support the different coaxial envelopes of the steam generators and the complete bundle by spacer plates in radial directions, so as to avoid relative displacements and shocks between these envelopes and the bundle in the case of external stresses such as those which accompany an earthquake.

This radial holding or supporting is obtained by abutments fixed to the envelope of the bundle level with the spacer plates, several abutments being provided for each spacer plate. These abutments are then evenly distributed over the periphery of the spacer plates.

Such a holding or supporting device is known from FR-A-2 511 491. It is constituted by parts having a thickness exceeding the thickness of the bundle envelope and having tapped holes into which can be screwed the threaded studs, whose end projecting into the space between the bundle envelope and the outer, rigid envelope bears against the inner surface of the outer envelope. The bearing action of these abutments is brought about following adjustment of the studs, by the introduction of wedge-like shims between the outer edge of the spacer plates and the inner surface of the bearing device directed towards the bundle.

Such abutments suffer from the disadvantage of occupying a large part of the width of the space between the bundle envelope and the outer envelope and consequently significantly reduce the passage cross-section for the water to be vaporized circulating in the space, and without providing a perfect seal. These abutments also have the disadvantage of requiring the introduction of shims into notches machined on the peripheral part of the spacer plates. These notches lead to a corresponding reduction of the distance between the peripheral tubes of the bundle and the edge of the spacer plates. If an adequate distance is to be maintained between the peripheral tubes and the plate, it is then necessary to reduce the number of tubes in the bundle. In addition, the abutments must have shapes which do not facilitate their fixing by welding in the wall of the bundle envelope.

Other devices for the radial holding of the bundle envelope and the spacer plates of a steam generator are disclosed in FR-A-2 562 996 and 4,503,903, 4,583,584, 4,690,206 and 4,768,582. None of these devices is entirely satisfactory. Their assembly and installation are generally complicated by the use of shims for some of them. Certain of these devices do not provide an adequate bearing surface for satisfactorily supporting the spacer plates.

SUMMARY OF THE INVENTION

In order to obviate these disadvantages, the present invention proposes a device permitting the radial supporting of the bundle envelope and the spacer plates of a steam generator and which ensures simpler and faster assembly than has been possible up to now. This supporting device also ensures better wedging or fixing of the spacer plates, due to a larger bearing surface therewith. These advantages are more particularly obtained by the use of double screw abutments.

The present invention therefore relates to a device for the radial supporting of the envelope of the bundle of tubes and the spacer plates of a steam generator. The steam generator incorporates a pressure envelope extending along a given axis, the bundle envelope also being elongated along the same axis and contained in the pressure envelope so as to leave an annular space between the two envelopes, the spacer plates being positioned at given intervals and transversely to the axis in the bundle envelope in order to support the said tubes, the supporting device being constituted by abutments traversing the wall of the bundle envelope and fixed to the wall level with the spacer plates. The abutments are distributed over the periphery of each spacer plate in order to radially separate the bundle envelope from the pressure envelope and in order to exert rigid holding stresses between the spacer plates and the bundle envelope, the abutments having means permitting their possible sliding on the inner face of the pressure envelope along the axis and screwing means for varying their radial dimensions with respect to the axis. Each abutment is constituted by a first part which comes into contact with the inner face of the pressure envelope, a second part and a third part for coming into contact with a spacer plate, the second part serving as an intermediary between the first and third parts, the first part having a first thread permitting its fixing by screwing to the bundle envelope by manipulating means, the said abutment sliding means and a second thread, the second part having a first thread for screwing it to the second thread of the first part by manipulating means and a second thread with the reverse direction to the first thread, the third part having a thread permitting its screwing to the second thread of the second part and means for exerting rigid holding stress on the spacer plate.

The first part can comprise a cylinder of revolution provided with an axial bore closed by a base ensuring the contact with the inner face of the pressure envelope, the outer wall of the cylinder carrying the first thread of the first part, its second thread being constituted by a tapping of the bore.

The second part can be a ring, whose outer and inner cylindrical faces carry in each case a thread of the second part.

The third part can have a cylindrical portion carrying its thread and extended by a base intended to contact with the spacer plate.

The manipulating means of the first and second parts can comprise at least one reception recess for a pin wrench.

The contact between the first part and the inner face of the pressure envelope can take place along a convex face of the first part so as to offer a point or punctiform contact and for in this way forming the sliding means.

The contact between the third part and the spacer plate can take place along a large bearing surface face of the third part exerting a pressure on the edge of the spacer plate.

BRIEF DESCRIPTION OF THE DRAWINGS

An embodiment of the invention is described in greater detail hereinafter with reference to the attached drawings.

DETAILED DESCRIPTION

Figure 1:
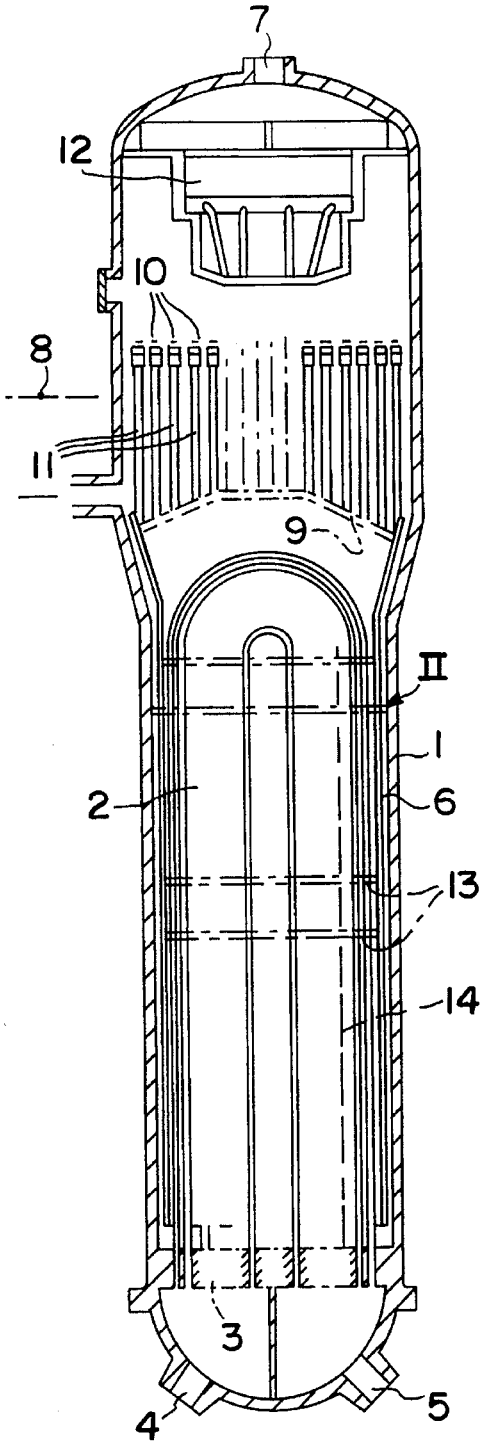
FIG.1 PRIOR ART
FIG. 1 is a vertical sectional view of a steam generator used in pressurized water nuclear reactors.

FIG. 1 shows a steam generator or boiler, whose outer, pressure-resistance envelope 1 contains in its lower, smaller diameter portion a tube bundle 2 having a plurality of inverted U-shaped tubes. These tubes are traversed by pressurized water forming part of the primary circuit and introduced into the steam generator beneath a tube sheet 3 through an inlet 4. The pressurized water traverses the tubes of the tube bundle 2 and then again passes beneath the tube sheet 3 and out through the outlet 5.

The lower portion of the tube bundle 2 is surrounded by a bundle envelope 6 constituting the vaporization enclosure within which the feed water in contact with the tube bundle 2, traversed by the high temperature water leaving the reactor core, progressively vaporizes on rising within the enclosure 6. The top portion of the steam generator dome is provided with an orifice 7 for discharging the steam to the turbine.

A feed water supply device (not shown) makes it possible to maintain the feed water level 8 in the steam generator at a certain distance above the tube bundle 2 and below cyclones 10 constituting the first stage of the steam separator and communicating with the top of the vaporization enclosure 6 by tubular columns 11. These tubular columns are welded to the roof 9 of the vaporization enclosure 6 and permit communication with the interior of the enclosure. This feed water firstly passes into the space between the outer envelope 1 and the enclosure 6 in order to reach the lower end of the enclosure.

At the cutlet from the cylones 10, the steam, which has given off most of the entrained water, passes into secondary separators 10 constituted by baffles permitting more complete drying of the steam prior to its discharge through the orifice 7.

The tubes of the bundle are laterally supported by spacer plates 13 arranged transversely within the bundle envelope 6. Ties 14 fixed in their lower part to the tube sheet 3 make it possible to maintain the axial spacing of the spacer plates 13.

Figure 2:
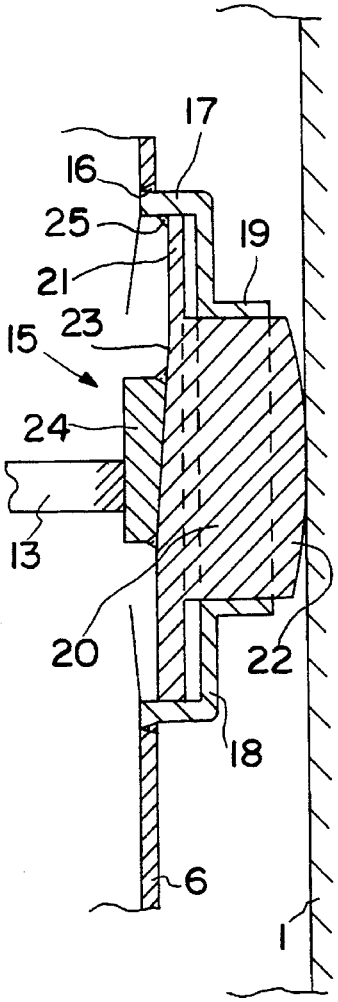
FIG.2 PRIOR ART
FIG. 2 shows a stop or abutment for the radial supporting of the bundle envelope and spacer plates of a steam generator.

FIG. 2 is a larger scale view of zone II in FIG. 1. It clearly shows one of the abutments for holding or supporting a spacer plate 13. The abutment 15 is fixed to the bundle envelope 6. In order to carry out this fixing, the envelope 6 has a radial opening 16 permitting the passage and fixing of a structure incorporating a radial sleeve 17 welded to the envelope 6 by one of its ends and projecting slightly into the annular space between the pressure envelope 1 and the bundle envelope 6. The structure also comprises an annular plate 18 welded to the end of the sleeve 17 located in the annular space and which partly seals the sleeve 17. Finally the structure comprises a second sleeve 19 placed in the alignment of the first sleeve 17 and which is welded to the edge of the hole of the annular plate 18.

The abutment comprises a generally cylindrical part 20, which is engaged in the aforementioned structure until it comes into contact with the inner wall of the pressure envelope 1. The part 20 has portion 21 of larger diameter, this being very slightly smaller than the internal diameter of the sleeve 17, as well as a smaller diameter portion 22, which is very slightly smaller than the internal diameter of the sleeve 19. The face of the part 20 directed towards the interior of the bundle envelope 6 is machined in order to form a bearing surface 23 inclined with respect to the vertical by an angle close to 5°. The inclination angle of this bearing surface corresponds to the machining angle of the shims 24 interposed between the spacer plate 13 and the part 20. The end of the portion 22 of the part 20 directed towards the pressure envelope is machined in order to form a spherical bearing surface on the pressure envelope.

For putting into place the supporting abutments, the parts 20 are placed in their recesses and in contact with the pressure envelope 1. Each part 20 is then welded by a circular weld bead 25 to the inner face of the sleeve 17. A set of shims 24 is then placed and welded between the bearing surface 23 and the edge of the spacer plate 13 in order to bring about a rigid supporting action between the spacer plates and the bundle envelope.

Figure 3:
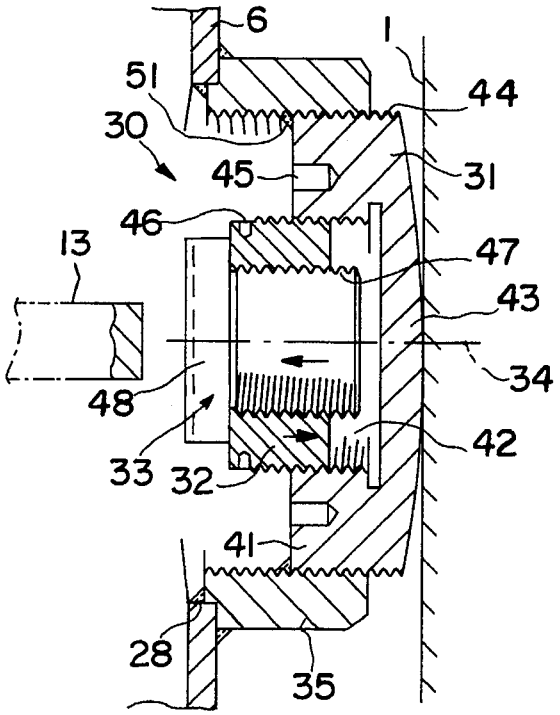
FIG. 3 shows a radial supporting abutment corresponding to that of FIG. 2, the abutment being in the course of installation.
Figure 4:
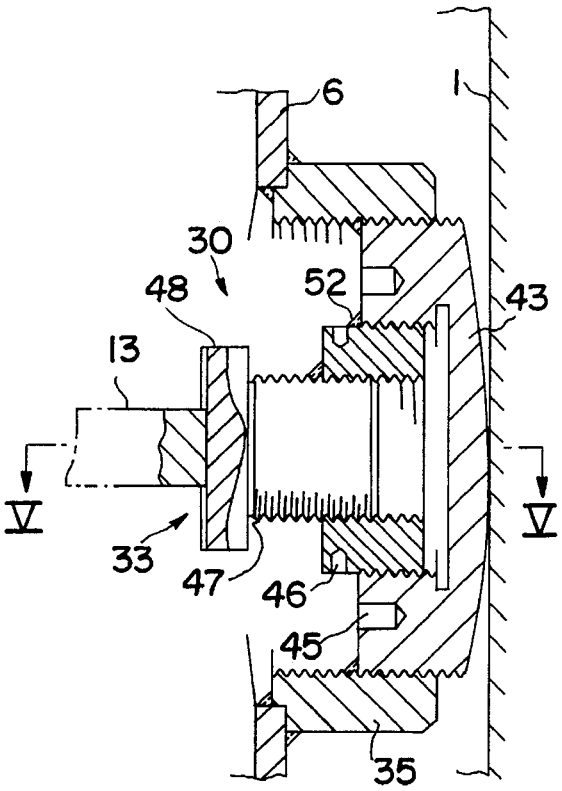
FIG. 4 shows the abutment of FIG. 3 at the end of installation.
Figure 5:
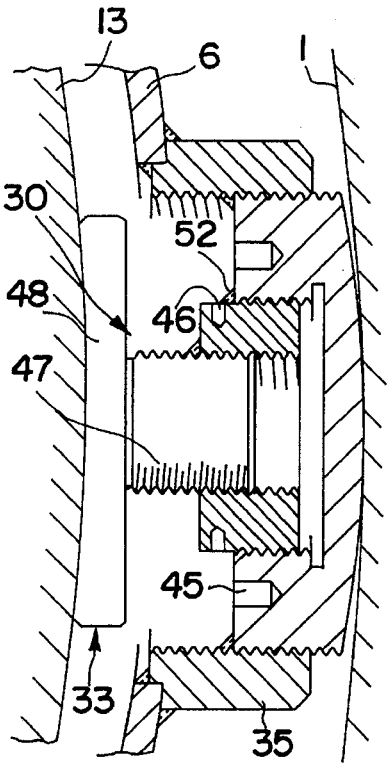
FIG. 5 is a view of the radial supporting abutment along section V—V of FIG. 4.
Figure 6:
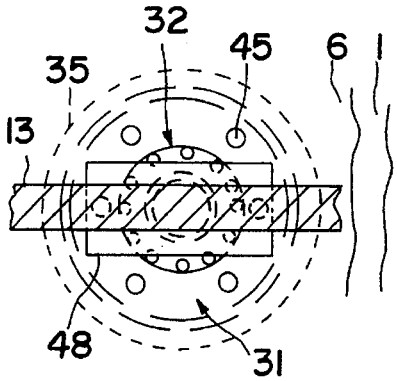
FIG. 6 is a view from the left of FIG. 4.

A description will now be given of the supporting device according to the invention which omits the use of shims used in the prior art devices. FIGS. 3 and 4 show the abutment in accordance with the same view, but at different stages of its installation. FIGS. 5 and 6 are a plan view and a view from the left of FIG. 4, respectively. It is possible to see the pressure envelope 1, the bundle envelope 6 and a spacer plate 13. The abutment 30 is constituted by a first part 31, a second part 32 and a third part 33 having a common axis 34. A collar 35 is welded to a circular, axial opening 28 level with the spacer plate 13. It occupies part of the annular space separating the two envelopes. It is tapped in order to receive the abutment 30 by screwing.

The first part 31 comprises a cylinder of revolution 41 having an axial bore 42 closed by a base 43. The outer wall 44 of the cylinder 41 carries a thread permitting the abutment to be screwed to the collar 35. The bore 42 is tapped so that the part 31 can receive, by screwing, the second part 32. The base 43 has a convexity in the direction of the pressure envelope 1. The part 31 also has recesses 45 permitting its manipulation by a pin wrench.

The second part 32 is a ring having an outer thread for its screwing to the part 31 and an internal thread for the reception of part 33 by screwing. It also has recesses 46 permitting its manipulation by a pin wrench. The third part 33 has a threaded cylindrical portion 47 permitting the screwing of the part 33 to the part 32. This portion 47 is extended by a base 48.

The assembly of the bundle envelope and the spacer plates in the steam generator takes place in the following way. The lower portion of the steam generator is installed horizontally. The bundle envelope 6 is provisionally fixed in position within the steam generator. At this stage, there is neither a tube, nor a spacer plate within the steam generator. The positioning of the bundle envelope 6 is checked by means of feeler gauges through smooth holes in the bundle envelope in order to obtain the requisite distance between the bundle envelope and the pressure envelope.

The abutments 30 equip the collars 35. They are mounted in the contracted position, i.e., their radial dimension is reduced as is the case for FIG. 3. However, unlike in FIG. 3, the first part 31 does not project beyond the collar 35. It is only when the positioning of the bundle envelope 6 in the pressure envelope 1 has taken place that the parts 31 are manipulated in order to bring them into contact with the inner face of the pressure envelope. A weld bead 51 makes it possible to fix the setting obtained.

The spacer plates are gradually installed with ties and are fixed with the aid of abutments. Each plate is fixed by a set of ties called "fishing rods", whose different segments are screwed onto one another during the installation of the plates, the first tie being fixed to the tube sheet. The spacer plates are positioned in such a way that the passage holes of the tubes with which they are provided are aligned with one another and with the holes of the tube sheet.

When a spacer plate has been introduced, the part 32 is manipulated with a pin wrench in order to embed it in the part 31. This leads to translation without rotation of the part 33 towards the spacer plate 13. These relative movements are indicated by the arrows in FIG. 3.

In this way the part 33 is made to abut against the edge of the spacer plate 13, as shown in FIG. 4.

In exemplified manner, it is possible to provide for the part 32 an external thread with a right-hand 3 mm pitch and an internal thread with a 6 mm left-hand pitch.

Weld beads 53 between the parts 32, 33 and optionally 52 between the parts 32, 31 terminate the installation of the abutment.

FIG. 6 shows that the contact between the third part 33 and the spacer plate 13 takes place along a large bearing surface face of the base 48.

Thus, the device according to the invention ensures the combination of the two following functions:

adjustment of the spacing between the bundle envelope and the pressure envelope during installation, rigid holding of the bundle envelope and the spacer plates in a horizontal plane, the envelope and spacer plates maintaining their degree of freedom in the vertical direction.

This holding or supporting action corresponds to the anti-earthquake function. It makes it possible to make the pressurized enclosure participate in taking up the accidental horizontal forces and stresses transmitted by the spacer plates.

I claim:

1. Device for radial support of an envelope of a tube bundle and spacer plates of a steam generator, said steam generator incorporating a pressure envelope elongated along a given axis, said envelope of said tube bundle being elongated along a same axis and disposed within said pressure envelope so as to leave an annular space between said two envelopes, said spacer plates being positioned at given intervals and transversely to said axis in said envelope of said tube bundle in order to support tubes of said bundle, said device being constituted by abutments traversing a wall of said bundle and fixed to said wall level with said spacer plates, said abutments being distributed over a periphery of each spacer plate in order to radially separate said envelope of said tube bundle from said pressure casing and to exert rigid holding stresses between said spacer plates and said envelope of said tube bundle, said abutments comprising means enabling sliding of said abutments on an inner face of said pressure envelope along said axis and screwing means for varying radial dimensions of said abutments with respect to said axis, each of said abutments being constituted by a first part which comes into contact with said inner face of said pressure envelope, a second part and a third part for coming into contact with a spacer plate, said second part serving as an intermediary between said first and third parts, said first part having a first thread enabling it to be screwed to said envelope of said tube bundle by manipulating means, said abutment sliding means and a second thread, said second part having a first thread for screwing it to said second thread of said first part by manipulating means and a second thread with a direction reverse to said first thread, said third part having a thread enabling it to be screwed to said second thread of said second part and means for exerting said rigid holding stress on said spacer plate.

2. Device according to claim 1, wherein said first part has a cylinder of revolution provided with an axial bore closed by a base ensuring contact between said inner face of said pressure envelope, an outer wall of the cylinder carrying said first thread of said first part, its second thread being constituted by a tapping of said bore.

3. Device according to claim 1, wherein said second part is a ring having outer and inner cylindrical faces in each case carrying a thread of said second part.

4. Device according to claim 1, wherein said third part has a cylindrical portion carrying its thread and extended by a base which contacts said spacer plate.

5. Device according to claim 1, wherein said manipulating means of said first part include at least one reception recess for a pin wrench.

6. Device according to claim 1, wherein said manipulating means for said second part include at least one reception recess for a pin wrench.

7. Device according to claim 1, wherein the contact between said first part and said inner face of said pressure envelope is made via a convex face of said first part so as to offer a point contact and thus form said sliding means.

8. Device according to claim 1, wherein the contact between said third part and said spacer plate is made via a large bearing surface face of said third part exerting pressure on an edge of said spacer plate.

* * * * *